US005101891A

United States Patent [19]

Kadle

[11] Patent Number: 5,101,891

[45] Date of Patent: Apr. 7, 1992

[54] HEAT EXCHANGER TUBING WITH IMPROVED FLUID FLOW DISTRIBUTION

[75] Inventor: Prasad S. Kadle, Getzville, N.Y.

[73] Assignee: General Motors Corporation, Detroit, Mich.

[21] Appl. No.: 709,059

[22] Filed: Jun. 3, 1991

[51] Int. Cl.[5] ..... F28F 3/08

[52] U.S. Cl. ..... 165/152; 62/525; 165/153

[58] Field of Search ..... 62/525; 165/152, 153, 165/167

[56] References Cited

U.S. PATENT DOCUMENTS

| | | | |
|---|---|---|---|
| 2,229,940 | 1/1941 | Spofford | 62/525 |
| 3,900,175 | 8/1959 | McGuffey | 62/525 X |
| 3,976,128 | 8/1976 | Patel et al. | 165/153 |
| 4,217,953 | 8/1980 | Sonoda et al. | 165/44 |
| 4,274,482 | 6/1981 | Sonoda | 165/153 |
| 4,470,455 | 9/1984 | Sacca | 165/167 |
| 4,535,839 | 8/1985 | Sacca | 165/153 |
| 4,600,053 | 7/1986 | Patel et al. | 165/170 |

FOREIGN PATENT DOCUMENTS

| | | | |
|---|---|---|---|
| 56-12997 | 2/1981 | Japan | 62/525 |

*Primary Examiner*—Allen J. Flanagan
*Attorney, Agent, or Firm*—Ronald L. Phillips

[57] ABSTRACT

An evaporator for an automotive air conditioner having a plurality of tubes therein arranged side by side so that spaces are provided for air centers mounted between the sidewalls of the tubes. Each tube is formed from a pair of interfacing plates having ribs indented in a predetermined pattern therein to form discrete fluid flow sections within each tube. The ribs are interconnected in such a manner that the sections effectively vary and tailor the flow of the heat exchanger fluid to reduce or substantially eliminate dry out areas in each tube thereby increasing heat exchanger tube and evaporator efficiency.

5 Claims, 3 Drawing Sheets

HEAT EXCHANGER TUBING WITH IMPROVED FLUID FLOW DISTRIBUTION

FIELD OF THE INVENTION

This invention relates to heat exchangers and more particularly to new and improved fluid flow heat exchanger tubing having discrete internal sections ribbed to tailor the fluid flow paths therethrough for varying the heat transfer efficiency thereof to effect reduction of dry out areas in the tubing and thereby increase the efficiency of the tubing and the heat exchanger.

BACKGROUND OF THE INVENTION

Various multi plate heat exchangers have been devised prior to the present invention to increase their heat exchanger efficiency and usefulness. Among these heat exchangers is the type disclosed in my copending application U.S. Ser. No. 677,193 filed Mar. 29, 1991 for HIGH EFFICIENCY HEAT EXCHANGER WITH DIVIDER RIB LEAK PATHS, assigned to the assignee of this invention and hereby incorporated by reference. In my copending application, spaced leak paths were provided in the centralized divider rib of U-flow type evaporator tubes to ensure that some of the refrigerant would be supplied to the outlet or vapor side of the tube so that localized dry out and hot spots would be reduced or eliminated and heat exchanger efficiency would be thereby improved.

This heat exchanger is of the general category of that disclosed in my co-pending application but has a plurality of flattened tubes which are operatively joined at upper and lower tank ends to form a core for the passage of volatile heat exchanger fluid therethrough from an intake pipe to an outlet. Each of these tubes are formed from a pair of plates having indented rib patterns therein to vary the flow path through the tube to enhance the heat exchanger efficiency.

This invention is preferably employed as tubing for an evaporator for an air conditioner in which the heat exchanger fluid changes state from a liquid phase to a gaseous phase as it courses through the evaporator tubing. Such heat exchanger tubes are generally oval or rectilinear in shape, and are arranged into a core so that the tubes have thin leading and trailing edges with sides flattened to provide large area heat exchanging surfaces therebetween. Air centers are conventionally installed between the walls defining the sides of the tubes to increase the efficiency of the core. This construction also allows the air to flow across the large surface areas of the tubes with minimized resistance.

With prior constructions local dry out areas may occur near the outlet ends of each tube causing the heat transfer rate to be significantly reduced. This reduction occurs because the gaseous phase of the fluid has lower heat transfer efficiency than the liquid phase or when the fluid in a transition liquid and gas phase. Furthermore, the front or air inlet side of the heat exchanger is more effective in absorbing heat transfer than the back or air outlet side thereof. This is caused in part by the fact that the front side of the heat exchanger encounters and absorbs more heat energy than the back side as air is blown past the tubes of the core. Accordingly, dry out or hot spot areas generally occur near the heat exchanger outlet of each tube and near the front or air inlet side.

In view of the above, this invention provides a new and improved evaporator which features unique construction that eliminates or sharply reduces local dry out areas in an evaporator by improving control of the change in phase from a liquid to a gas as the heat exchanger fluid courses through the heat exchanger tubing from the inlet to the outlet thereof. More particularly, by feeding increased quantities of heat exchanger liquid or by feeding a mixture containing higher quantity of liquid than vapor to the lower or outlet section of each tube, dry out areas will be significantly reduced and heat transfer efficiency will be improved.

Accordingly, it is a feature, object and advantage of this invention to provide a new and improved tube for use in a heat exchanger core in which heat exchanger fluid flow paths are provided from the heat exchanger inlet of the tubes to the outlet thereof so that increased quantities of volatile liquid can be fed to the outlet or lower sections of the tube so as to be available for vaporization in otherwise dry out areas to thereby increase the heat transfer efficiency of the heat exchanger tubing.

In a preferred embodiment of the present invention, dry out can be effectively eliminated by providing a rib pattern which enhances heat exchanger fluid flow in discrete sections of the tubing. These patterns are arranged to keep the lower part of each tube adequately fed with liquid heat exchanger fluid so that all portions of the tubing are effectively used to absorb the heat energy of the air blowing past the tubes to change the phase of the heat exchanger fluid into a gas phase.

The tube pass of this invention provides a highly efficient heat transfer design by providing a first tube section with a plurality of transversely extending rows of ribs having a crossed rib configuration in a first zone to provide a tortuous flow path for fluid for high efficiency heat transfer operation. The tube pass has a second and downstream zone or section with many avenues of flow including free bypass flow around the aligned rib rows so that heat exchanger liquid can pass therethrough without substantial vaporization, i.e., reduced efficiency. This tube pass further provides a third zone with an overlapping rib configuration which receives sufficient liquid from the second zone so that the heat absorption and efficiency in a third zone is enhanced since dry out areas are reduced or eliminated. Moreover, this arrangement provides excellent fluid distribution across the width of the tube pass and within the tube for efficient use of the extensive heat transfer area thus provided.

Further advantages, features and objects of the present invention will become more apparent from the following description and drawings in which.

DETAILED DESCRIPTION OF THE DRAWINGS

Figure 1:
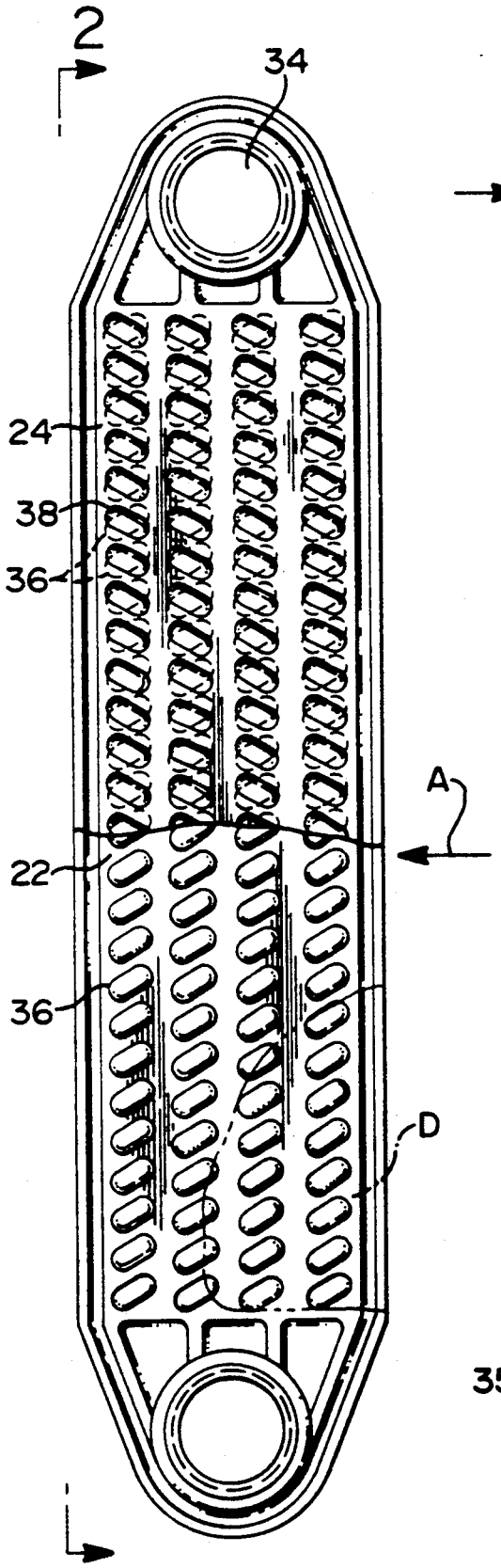
FIG 1 PRIOR ART
FIG. 1 is a planar view of a tube pass of an evaporator which is progressively broken away to show exterior portions of the top plate, and interior portions of the bottom plate.
Figure 2:
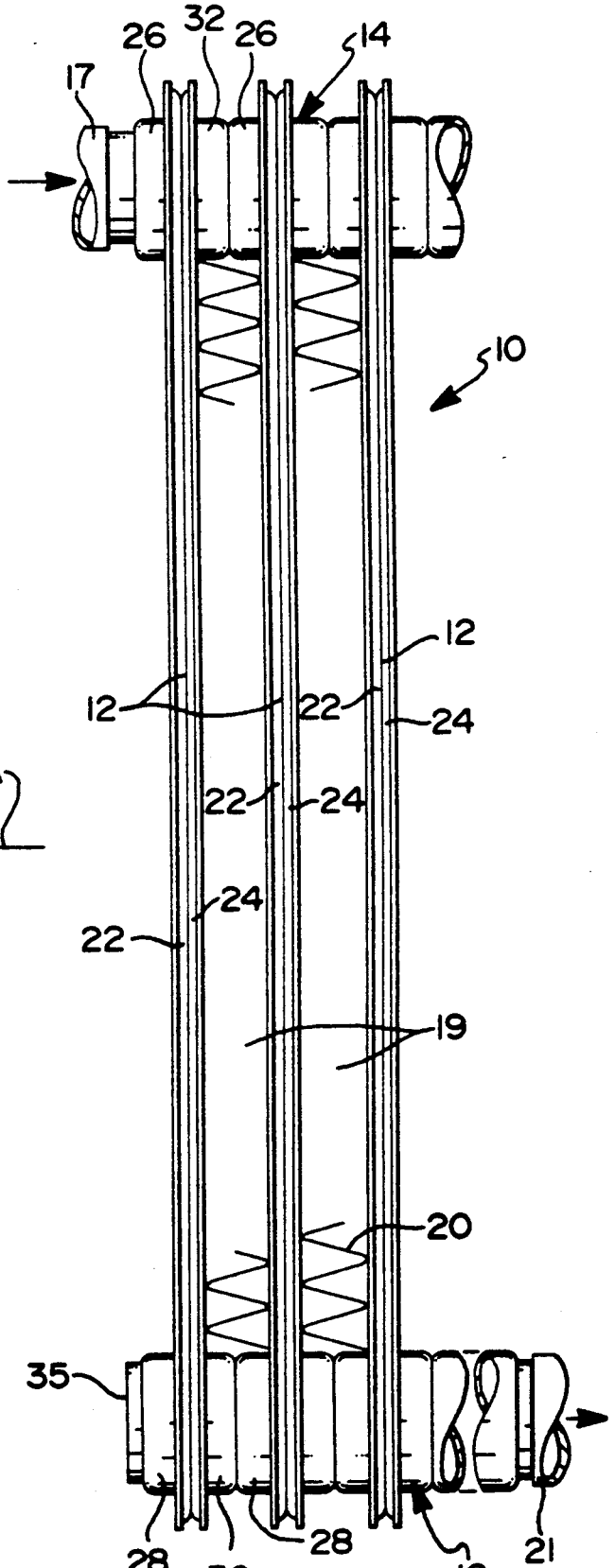
FIG 2 PRIOR ART
FIG. 2 is an elevational view of several stacked tube passes forming a portion of the evaporator core and looking in the direction of line 2—2 in FIG. 1.
Figure 3:
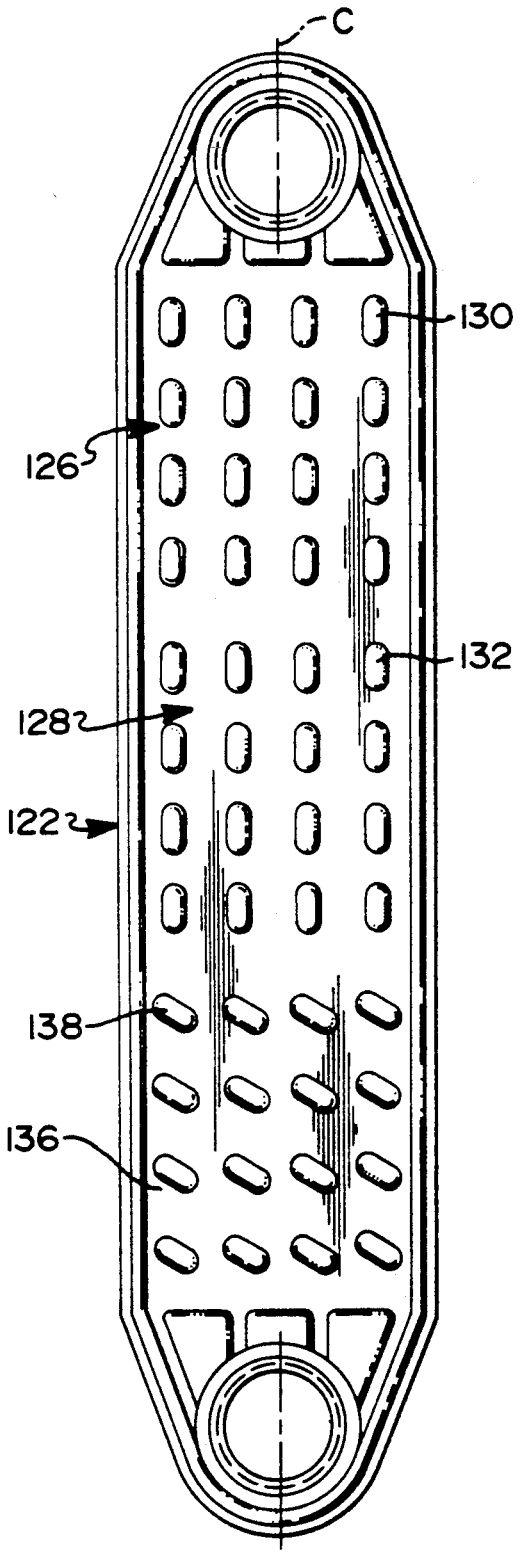
FIG. 3 is a plan view of a plate which forms one half of a heat exchanger tube according to this invention.

Turning now in greater detail to the drawings, there is shown in FIGS. 1 and 2 a finned cross flow heat exchanger 10 in the form of an evaporator core for an automotive air conditioning system adapted to be mounted within a module in the engine passenger compartment of the automobile. The heat exchanger or evaporator 10 comprises a plurality of generally flattened fluid conducting tubes 12 hydraulically interconnected with one another by upper and lower tank portions 14 and 16 to provide a flow path for the heat exchanger fluid supplied thereto by way of an intake pipe 17 operatively connected into the first tube 12.

The heat exchanger fluid is initially in a liquid state as it enters into the core of the heat exchanger from the condenser, not shown, and as it courses through the exchanger, the exchanger fluid boils and changes phase from liquid to a gaseous phase. The tubes 12 are physically mounted parallel to one another, and are operatively connected at their upper and lower ends by the tanks 14 and 16, and are arranged to define spaces 19 therebetween to accommodate air centers or fins 20.

These air centers 20, fixed between the flattened body portions of each of the plates interfaced to define each tube, are corrugated thin sheets of aluminum of other suitable metal and operate to increase the heat transfer performance of the heat exchanger.

In an air conditioner evaporator, a cross flow of air, flow arrow A, forced thorough the fins of the heat exchanger by a fan, whose speed and output is under control of vehicle occupants, loses heat energy to the refrigerant circulating internally through the tubes which boils and vaporizes and is discharged in the gaseous phase through an outlet pipe 21 to the compressor, not shown, which compresses the low pressure refrigerant vapor into a high pressure, high temperature vapor for circulating back to a condenser, and then back to the evaporator to complete a basic system to cool the interior of the automobile.

Each tube is fabricated from a pair of identical mating plates, identified for description purposes as top plate 22 and bottom plate 24, see FIG. 2. Each plate is a flat stamping except that the upper and lower ends have protuberances 26, 28 and 30, 32, respectively, are formed with openings, such as opening 34, with the exception of certain end plates that are blank, such as blank opening 35 in the left hand plate 22. Adjacent tubes operatively interconnect with one another to transmit heat exchanger fluid from the inlet pipe 17 to the outlet pipe 21. The protuberances, which define the tank portions 14 and 16 are interconnected by a projecting annular collar formed around an end opening in one protuberance, which closely fits and connects into the opening of the protuberance of the adjacent tube when the tubes are stacked for mechanical interconnection with one another, as is well known in this art.

As shown in the drawings, each core plate has a pattern of indented ribs 36 or 38, which when the core plates are reversed and brazed together provide for optimized mechanical strength and for a tortuous flow path through each tube for effective transfer of heat energy between the heat exchanger fluid and the ambient air. While such heat exchangers are effective evaporator for absorbing heat energy, local dry out may appear such as illustrated by area D of each tube of FIG. 1. With the heat exchanger fluid primarily in a vapor state, coursing to the bottom tank 16, heat transfer efficiency of each tube is inherently reduced and the overall efficiency of the heat exchanger is adversely affected.

Figure 5:
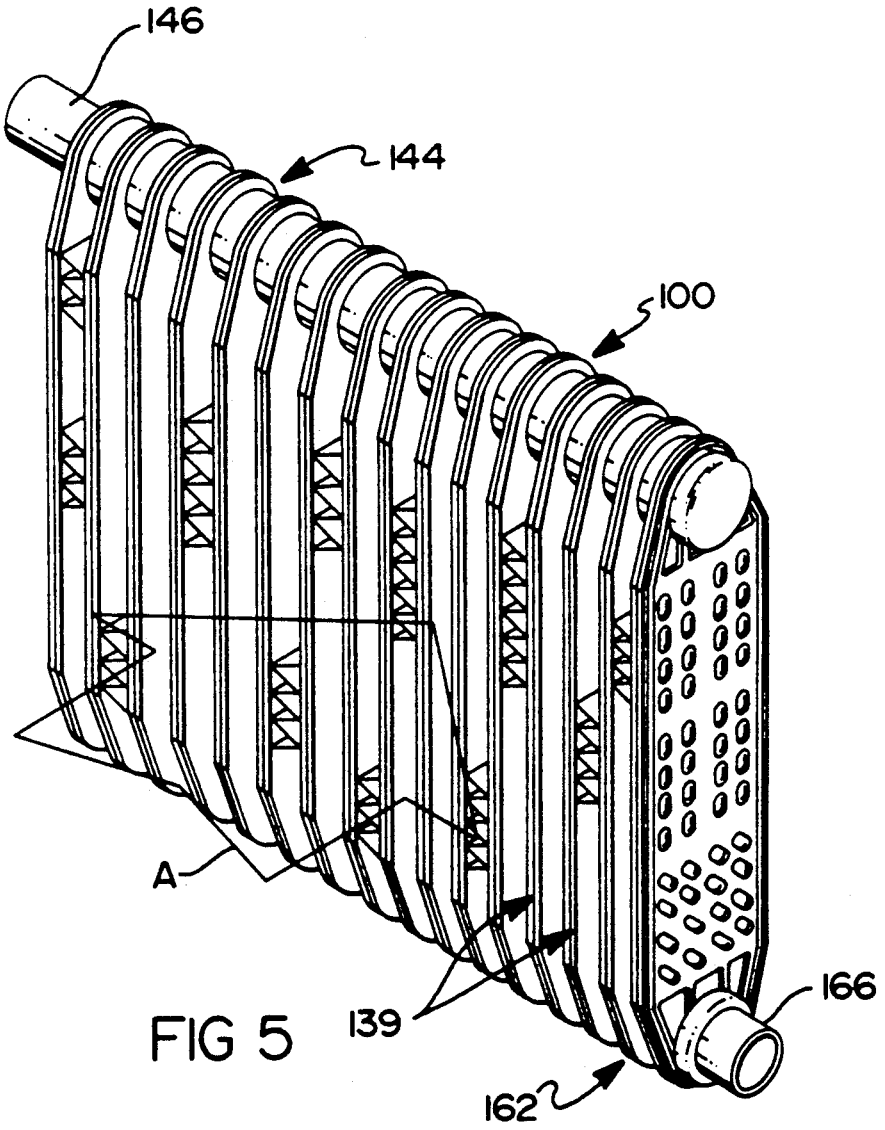
FIG. 5 is a pictorial view of a plate type evaporator in which the flow tubes of this invention are utilized.

To increase effectiveness of the separate tubes of a multi tube pass heat exchanger, shown at 100 in FIG. 5, identical plates 122, 124 of each tube are formed with first and second sections 126, 128 of elongated rows of ribs 130, 132 generally parallel with one another and the centerline C of the plates. A lower or third section 136 of each plate formed with angularly displaced ribs 138, which are parallel to one another and are in columns and ranks.

Figure 4:
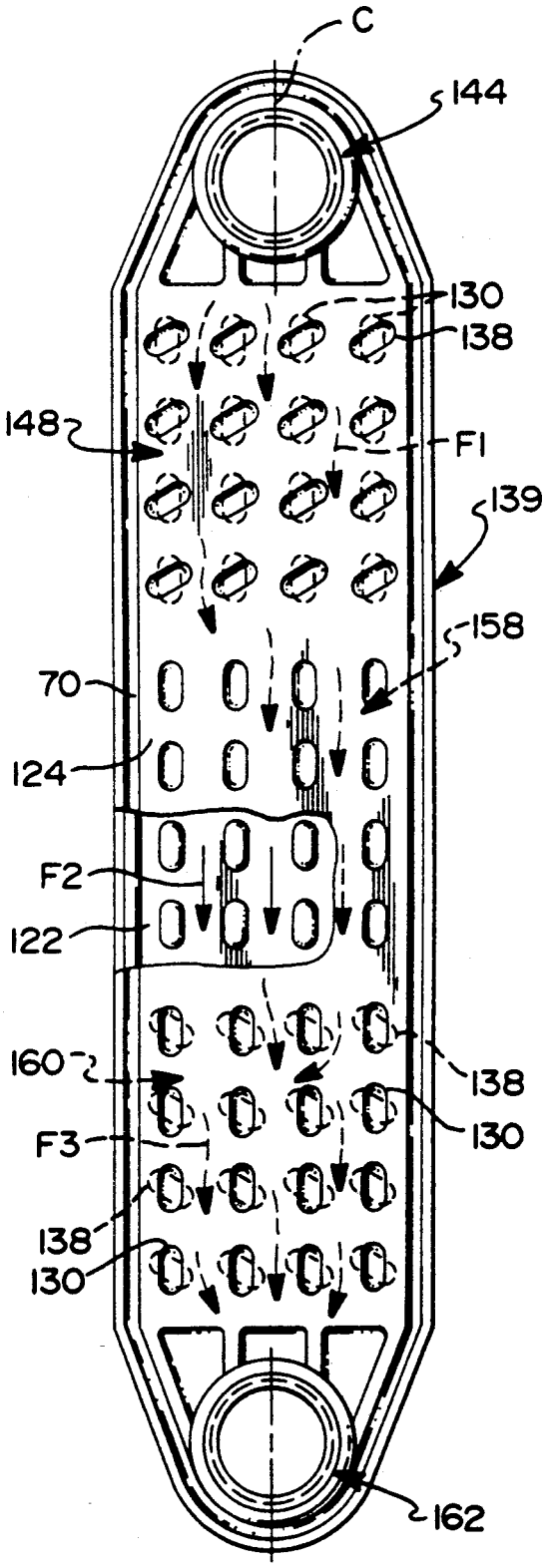
FIG. 4 is a planar view of a tube pass of the present invention which is partially broken away to illustrate the operation thereof.

As shown best in FIG. 4, the plates 122, 124 are reversed to overlap one another and are operatively connected to form tubes 139. This arrangement is such that when the heat exchanger fluid is fed into the upper tank 144, through an intake pipe 146, the first section in which ribs 130 and 138 are crossed to provide a tortuous flow path, flow arrows F-1, in the first section 148. The first section of the tube pass 139 accordingly operates with an optimum heat transfer efficiency. The heat exchanger fluid leaving the first section 148 may be in a partially liquid and partially in a transition phase, i.e., partially liquid and partially vapor. On entering a second section 158 of the tube, turbulence is reduced because the ribs 132 of the top and bottom plates interface with one another to provide substantially unblocked channels, flow arrows F-2, so that the heat transfer efficiency is effectively reduced. This results in the increased supply of heat exchanger fluid in a liquid state into the third section 160.

As shown in the tube 139 of FIG. 4, the third section 160 is substantially the same as the first section since the plates are overlapped and has ribs 138 which are crossed with ribs 130 to again provide tortious flow path, flow arrows F-3, so turbulent flow occurs to again increase the efficiency and performance of the third section with dry out areas eliminated as the fluid, substantially in a vapor state, enters the lower tank 162.

Importantly in this invention, each plate is formed with specialized rib construction to overlie one another when reversed to make a tube to form discrete sections prevent dry out areas in the tubes as the heat exchanger fluid flows from the upper to the lower tank and the fluid changes from a liquid to a gaseous phase. Accordingly, the dry out areas, which are essentially areas in which there is little or no liquid to absorb heat energy, are reduced or eliminated. This invention accordingly provides strategically spaced flow zones and paths to enable some of the fluid in the liquid state to flow through some or all zones and areas of each of the tubes until discharged through outlet pipe 166. This provides an optimized distribution of the liquid refrigerant so that the efficiency of the evaporator as a unit will be materially increased.

As shown best in FIGS. 4 and 5, the heat exchanger fluid flows through the tubes and the hot air, flow arrow A, such as in the interior of the vehicle passenger compartment is blown across the outer surfaces of the tubes. Thermal energy of the air is transferred to the refrigerant causing some of the refrigerant to change to the gaseous state as it expands and exits through the vapor side of the tube. However, since the discrete sections are provided in this construction, quantities of the refrigerant R will remain in the liquid state, heat exchanger fluid and will be available so that there are no dry out areas and thereby heat exchanger efficiency is increased. With the sections tailoring the efficiency of each tube pass, there is optimized balance throughout all of the tubes comprising the heat exchanger 100 for an improved overall performance.

While the above description constitutes preferred embodiments of the invention, it will be appreciated that the invention can be modified and varied without departing from the scope and fair meaning of the accompanying claims.

I claim:

1. A tube for conducting vaporizable liquid heat exchanger fluid therethrough for use in a multi tube heat exchanger having an air intake side and an air outlet side, said tube having first and second interfacing plates operatively connected to one another and having an inlet and an outlet for said heat exchanger fluid, each of said plates having ribs cooperating with one another to define a plurality of discrete fluid flow sections for conducting said heat exchanger fluid from said inlet to said outlet, a first of said sections communicating directly with said inlet for receiving said heat exchanger fluid and having flow passages therein, a second of said sections communicating directly with said first section, a third of said sections hydraulically connecting said second section to said outlet, said second section having discrete fluid flow passage means formed therein so that said heat exchanger fluid received from said first section can flow into said third section while in at least a partial liquid phase to thereby increase the efficiency of said heat exchanger by virtue of said third section receiving quantities of heat exchanger fluid in a liquid state from said second section for subsequent vaporation and transfer of heat with respect to air flowing past said tube.

2. The tube defined in claim 1 above, wherein said second section has flow paths formed by a series of ribs which route the heat exchanger fluid therethrough with minimized turbulence to said third section, and said third section has flow paths formed by a series of ribs which receives and distributes said heat exchanger fluid throughout the extent of said third section to said outlet without localized dry out.

3. A heat exchanger having a plurality of flattened tubes operatively interconnected together to provide passages for conducting a volatile heat exchanger fluid therethrough, connector means for interconnecting said tubes so that air can flow between tubes which are adjacent to one another, said tubes having a leading edge and a trailing edge and flattened side portions that are laterally spaced from one another, a plurality of discrete fluid flow conducting sections arranged in series in each of said tubes, said sections being defined by an inlet section and an intermediate section and an outlet section, said intermediate section being formed with specialized flow passages for transmitting a portion of said volatile heat exchanger fluid into said outlet section so that said heat exchanger has increased potential for heat transfer because of the presence of volatile heat exchanger fluid throughout said third section.

4. A flat tube for use in an evaporator for an air conditioning system comprising a pair of substantially identical and operatively flat plates each formed with discrete groups of ribs interconnected in a face to face relationship, said tube having an inlet and an outlet for fluid refrigerant flow therethrough, said tube further having a plurality of separate sections directly connected in series said sections including an inlet section connected to said inlet an intermediate section hydraulically connected to said inlet section and an outlet section hydraulically connecting said intermediate section to said outlet to thereby provide a passage for said fluid refrigerant flowing therethrough, bypass means in said intermediate section to allow refrigerant to pass into said outlet section while at least in a partial liquid state so that said outlet section has liquid refrigerant therein and so that dry out areas in said outlet section are reduced.

5. A method of distributing the flow of heat exchanger fluid in a tube pass of a heat exchanger, which has the capability of changing the state of heat exchanger fluid from a flow of liquid to a gas within said tube pass to reduce dry out of areas of tube as said heat exchanger fluid courses from an inlet to an outlet in the tube pass comprising the steps of:

providing first ribs in a first section of the tube pass, which has interior contact with one another within said tube to provide first flow paths to enhance the transfer of heat energy between the heat exchanger fluid and a stream of air passing adjacent to said tube pass;

providing a second ribs in a second section of the tube pass downstream of said first section which have interior contact with one another to provide second flow paths for reduced enhancement of heat transfer as compared to said first section so that said heat exchanger fluid at least partially in a liquid state, and providing a third rib pattern in a third section of said tube pass which optimizes the transfer of heat between air passing adjacent to the third section and the heat exchanger fluid coursing to the outlet therein thereby optimizing heat exchanger performance by reducing localized dry out of portions of a said third section of said tube.

* * * * *